US009351093B2

(12) United States Patent
Kim et al.

(10) Patent No.: US 9,351,093 B2
(45) Date of Patent: May 24, 2016

(54) MULTICHANNEL SOUND SOURCE IDENTIFICATION AND LOCATION

(71) Applicant: Adobe Systems Incorporated

(72) Inventors: Minje Kim, Savoy, IL (US); Gautham J. Mysore, San Francisco, CA (US); Paris Smaragdis, Urbana, IL (US)

(73) Assignee: Adobe Systems Incorporated, San Jose, CA (US)

( * ) Notice: Subject to any disclaimer, the term of this patent is extended or adjusted under 35 U.S.C. 154(b) by 204 days.

(21) Appl. No.: 14/140,371

(22) Filed: Dec. 24, 2013

(65) Prior Publication Data

US 2015/0181359 A1 Jun. 25, 2015

(51) Int. Cl.
*H04R 3/00* (2006.01)
*H04S 7/00* (2006.01)

(52) U.S. Cl.
CPC ..... *H04S 7/30* (2013.01); *H04S 2400/11* (2013.01); *H04S 2400/15* (2013.01); *H04S 2420/01* (2013.01)

(58) Field of Classification Search
None
See application file for complete search history.

(56) References Cited

U.S. PATENT DOCUMENTS

2012/0075336 A1* 3/2012 Oda ..... G01C 21/367 345/629
2014/0140517 A1* 5/2014 Kim ..... H04R 29/00 381/56

OTHER PUBLICATIONS

Bryan, et al., "An Efficient Posterior Regularized Latent Variable Model for Interactive Source Separation", the International Conference on Machine Learning (ICML), Atlanta, GA. Jun. 2013, 9 pages.
Kim, et al., "Collaborative Audio Enhancement Using Probabilistic Latent Component Sharing", in Proceedings of the IEEE International Conference on Acoustics, Speech, and Signal Processing (ICASSP), Vancouver, BC, Canada, May 26-31, 2013, 5 pages.
Kim, et al., "Gaussian mixture model for singing voice separation from stereophonic music", in Audio Engineering Society Conference: 43rd International Conference, Kyoto, Japan, Sep. 2011, 6 pages.
Kim, et al., "Stereophonic Spectrogram Segmentation Using Markov Random Fields", 2012 IEEE International Workshop on Machine Learning for Signal Processing, Sep. 23-26, 2012, Santander, Spain, 2012, 6 pages.
Yilmaz, et al., "Blind Separation of Speech Mixtures via Time-Frequency Masking", IEEE Trans. on Signal Processing, vol. 52, No. 7, 2004, pp. 1830-1847, 2004, 30 pages.

* cited by examiner

*Primary Examiner* — Regina N Holder
(74) *Attorney, Agent, or Firm* — Wolfe-SBMC

(57) ABSTRACT

Multichannel sound source identification and location techniques are described. In one or more implementations, source separation is performed using a collaborative technique for a plurality of sound data that was captured by respective ones of a plurality of sound capture devices of an audio scene. The source separation is performed by recognizing spectral and temporal aspects from the plurality of sound data and sharing the recognized spectral and temporal aspects, one with another, to identify one or more sound sources in the audio scene. A relative position of the identified one or more sounds sources to the plurality of sound capture devices is determined based on the source separation.

20 Claims, 9 Drawing Sheets

600

(a) Histogram of $ILD$ values calculated from the ordinary mixture spectrograms (b) Histogram of $ILD_s$ values calculated from the decomposed spectrograms

700

Original $S_1$ spectrograms from the left channel (top) and right channel (bottom)

$\hat{S}_1$ from ordinary clustering $\hat{S}_1$ from PLCS clustering

Original $S_2$ spectrograms from the left channel (top) and right channel (bottom)

$\hat{S}_2$ from ordinary clustering $\hat{S}_2$ from PLCS clustering

MULTICHANNEL SOUND SOURCE IDENTIFICATION AND LOCATION

BACKGROUND

The prevalence of multichannel sound capture devices is ever increasing. For example, even casual users and typical consumers may now have access to sound capture devices that are configured to capture two or more channels of sound data, such as to support a stereo recording of a concert and so on. Through the use of multiple channels, a user listening to these channels may be given a feeling of depth and location of source sources that generated the recorded sounds such that the recording may give a user a feeling of "being there".

Multichannel sound data may also be processed to support a variety of functionality. One example of this is to automatically determine a relative location of a sound source in the sound data. Thus, like the example above in which a user listening to the sound data may determine a relative position of a source so too may the sound data be processed by a computing device to determine such a position. However, conventional techniques that were utilized to perform this processing typically relied on orthogonality of the sources and thus may fail in certain instances, such as when the sources collide in one or more frequencies.

SUMMARY

Multichannel sound source identification and location techniques are described. In one or more implementations, source separation is performed using a collaborative technique for a plurality of sound data of an audio scene that was captured by respective ones of a plurality of sound capture devices. The source separation is performed by recognizing spectral and temporal aspects from the plurality of sound data and sharing the recognized spectral and temporal aspects, one with another, to identify one or more sound sources in the audio scene. A relative position of the identified one or more sounds sources to the plurality of sound capture devices is determined based on the source separation.

In one or more implementations, a system includes one or more modules implemented at least partially in hardware and configured to perform operations including performing source separation of a plurality of sound data of an audio scene using a collaborative technique that includes sharing recognized spectral and temporal aspects, one to another, to identify one or more sound sources in the audio scene. The system also includes at least one module implemented at least partially in hardware and configured to perform operations including determining a relative position of the identified one or more sounds sources based on the source separation.

In one or more implementations, one or more computer-readable storage media comprising instructions stored thereon that, responsive to installation on and execution by a computing device, causes the computing device to perform operations comprising performing source separation of a plurality of sound data, captured by respective ones of a plurality of sound capture devices of an audio scene, using a collaborative technique. The technique includes recognizing spectral and temporal aspects from the plurality of sound data and sharing the recognized spectral and temporal aspects, one with another, to identify one or more sound sources in the audio scene. A relative position of the identified one or more sounds sources to the plurality of sound capture devices is determined based on the source separation.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

DETAILED DESCRIPTION

Overview

Binaural cues may be used for multichannel source separation. For instance, Interchannel Level Difference (ILD), which is defined by pixel-wise log ratio of power spectrograms, may be utilized to determine a relative position of a sound source for multichannel sound recordings. For example, for two channels of sound data a pan position may be determined for a specific instrument in music, a speaker at a lecture, and so on. Conventional techniques, however, typically relied on the orthogonality of the source spectrums, e.g., that the mixed spectrums of several sources seldom collide in the same frequency bin. Consequently, these techniques could fail in such instances.

Multichannel sound source identification techniques are described. In one or more implementations, source separation is performed on a plurality of sound data of an audio scene, e.g., multichannel sound data, to identify one or more sound sources. The source separation may be performed in a variety of ways, such as through use of Probabilistic Latent Component Sharing (PLCS) as further described below. The source separated sound data may then be processed using interchannel level difference or other techniques to determine a relative position of the one or more sound source. In this way, the conventional strict assumption of orthogonality of the sound sources may be reduced and therefore these techniques may not fail in such instances.

In the following discussion, an example environment is first described that may employ the techniques described herein. Example procedures are then described which may be performed in the example environment as well as other environments. Consequently, performance of the example procedures is not limited to the example environment and the example environment is not limited to performance of the example procedures.

Example Environment

Figure 1:
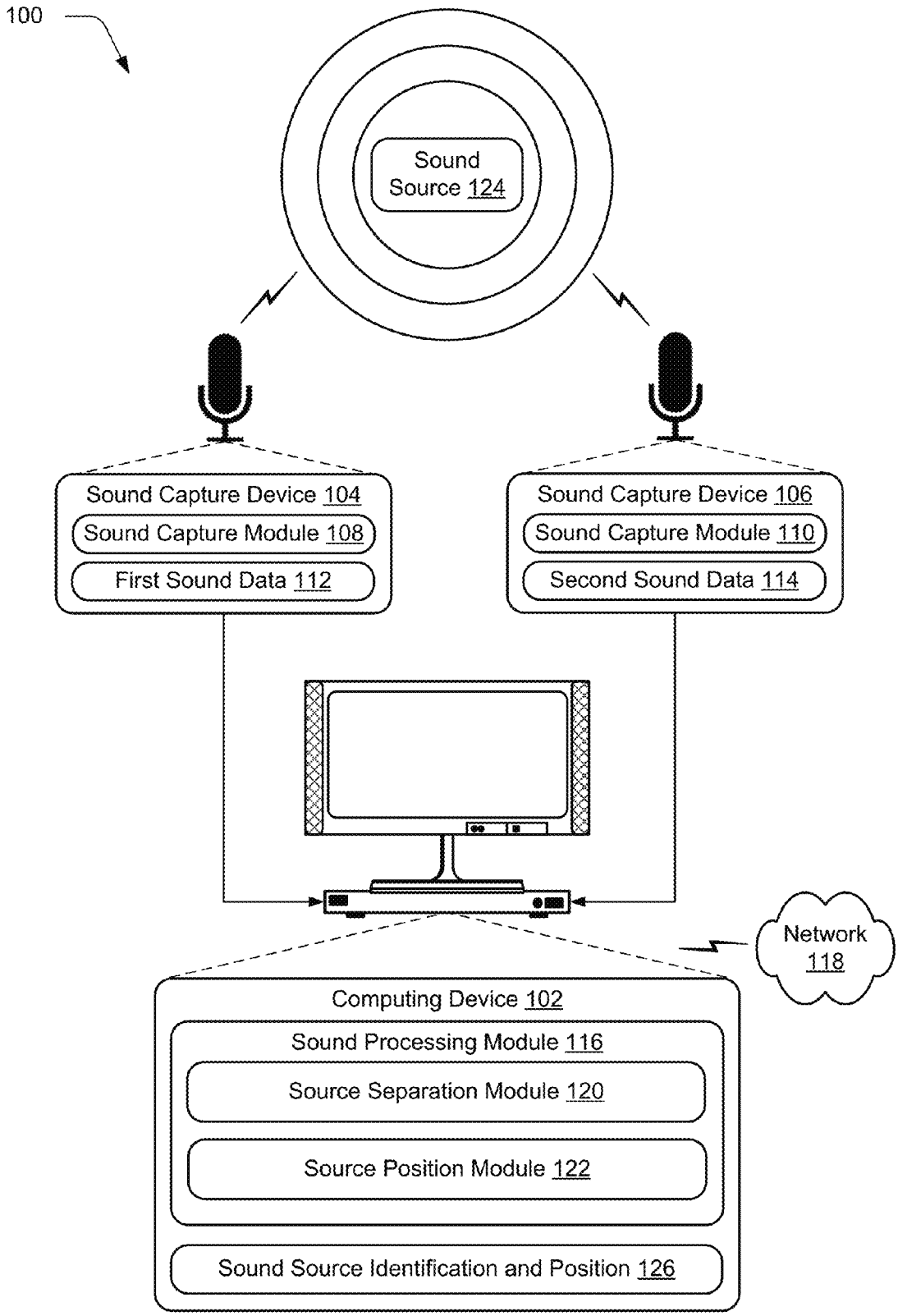
FIG. 1 is an illustration of an environment in an example implementation that is operable to perform identification and location techniques described herein.

FIG. 1 is an illustration of an environment 100 in an example implementation that is operable to employ the sound source identification and location techniques described herein. The illustrated environment 100 includes a computing device 102 and sound capture devices 104, 106, which may be configured in a variety of ways.

The computing device 102, for instance, may be configured as a desktop computer, a laptop computer, a mobile device (e.g., assuming a handheld configuration such as a tablet or mobile phone), and so forth. Thus, the computing device 102 may range from full resource devices with substantial memory and processor resources (e.g., personal computers, game consoles) to a low-resource device with limited memory and/or processing resources (e.g., mobile devices). Additionally, although a single computing device 102 is shown, the computing device 102 may be representative of a plurality of different devices, such as multiple servers utilized by a business to perform operations "over the cloud" as further described in relation to FIG. 9.

The sound capture devices 104, 106 may also be configured in a variety of ways. Illustrated examples of one such configuration involves standalone devices but other configurations are also contemplated, such as part of a mobile phone, video camera, tablet computer, part of a desktop microphone, array microphone, and so on. Additionally, although the sound capture devices 104, 106 are illustrated separately from the computing device 102, the sound capture devices 104, 106 may be configured as part of the computing device 102, a single sound capture device may be utilized in each instance, both sound capture devices 104, 106 may represent functionality of a single standalone device, and so on.

The sound capture devices 104, 106 are each illustrated as including respective sound capture modules 108, 110 that are representative of functionality to generate sound data from signals recorded from an audio source, examples of which include first and second sound data 112, 114. For instance, the first and second sound data 112, 114 may be representative of separate channels of a multichannel recording of an audio scene, such as a concert, lecture, and so on. This data may then be obtained by the computing device 102 for processing by a sound processing module 116. Although illustrated as part of the computing device 102, functionality represented by the sound processing module 116 may be further divided, such as to be performed "over the cloud" via a network 118 connection, further discussion of which may also be found in relation to FIG. 9.

The sound processing module 116 is representative of functionality that may be utilized to process sound data, such as the first and second sound data 112, 114. An example of this functionality is illustrated by a sound separation module 120 and a source position module 122. The sound separation module 120 is representative of functionality to recognize respective sounds sources of portions of sound data, e.g., in the first and second sound data 112, 114.

For example, the sound separation module 120 may employ techniques to decompose the first and second sound data 112, 114 into three input matrixes. This may be performed by a probabilistic counterpart of NMF, which may be referred to a probabilistic latent component analysis (PLCA). The three input matrixes, for instance, may be used to support tri-factorization (e.g., via symmetric PLCA) and sound probabilistic interpretation of a model. Further, the source separation module 120 may support sharing during the processing of the first and sound data 112, 114 such that knowledge obtained in the processing of the first sound data 112 may be leveraged for use in processing of the second sound data 114 and vice versa as further described below.

Likewise, the source position module 122 may employ a variety of different techniques to analyze the first and second sound data 112, 114 to determine a position of a sound source 124. This may include processing of an output of the source separation module 120 that is utilized to uniquely identify which portions of the first and second sound data 112, 114 correspond with a particular sound source to determine a relative position of that source, which is output as a sound source identification and position 126 data.

For example, interchannel level difference (ILD) may be utilized to determine a panning position of the sound source 124 in relation to the sound capture devices 104, 106. The interchannel level different may be expressed as a log ratio of power spectrograms as follows:

$$ILD(f,t) = 10\log_{10}\frac{X^L(f,t)^2}{X^R(f,t)^2},$$

where "$X^L(f,t)$" and "$X^R(f,t)$" stand for the mixture spectrogram element at time "t" and frequency "f" in left and right channels, respectively. Once the orthogonality holds, at a given time-frequency position the following three equations may be written:

$$ILD(f,t) = 10\log_{10}\frac{X^L(f,t)^2}{X^R(f,t)^2} = 10\log_{10}\frac{(S_1^L(f,t)+S_2^L(f,t))^2}{(S_1^R(f,t)+S_2^R(f,t))^2} \approx 10\log_{10}\frac{S_1^L(f,t)^2}{S_1^R(f,t)^2}$$

where the third equation is from the assumption that the second source "$S_2$" is not active at "(f,t)." Therefore, each ILD value of the mixture signals is from either "$S_1$" or "$S_2$" and not from the sum of them. If the sound sources have distinct panning positions, the problem boils down to a clustering problem in which each spectrogram position is assigned to either "$S_1$" or "$S_2$" based on the clustering.

As previously described, however, in some instances sound data from a plurality of sound sources may collide. Consequently, an assumption may not hold that "/LD(f,t)" belongs to either of the two sources in such a situation, because the third equation above does not hold.

Figure 2:
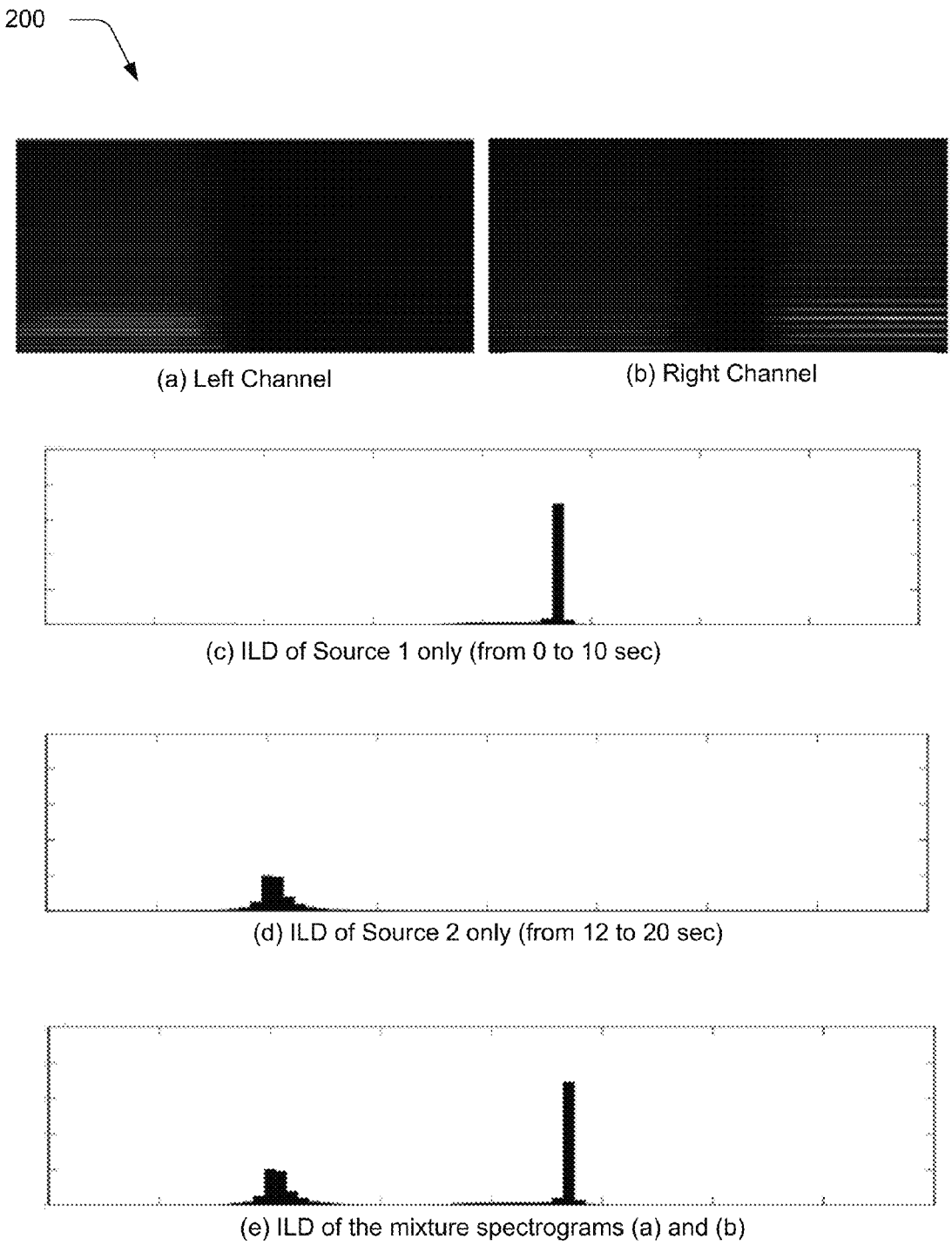
FIGS. 2 and 3 show a comparison of cases in which a collision of sound data from sources does and does not occur.
Figure 3:
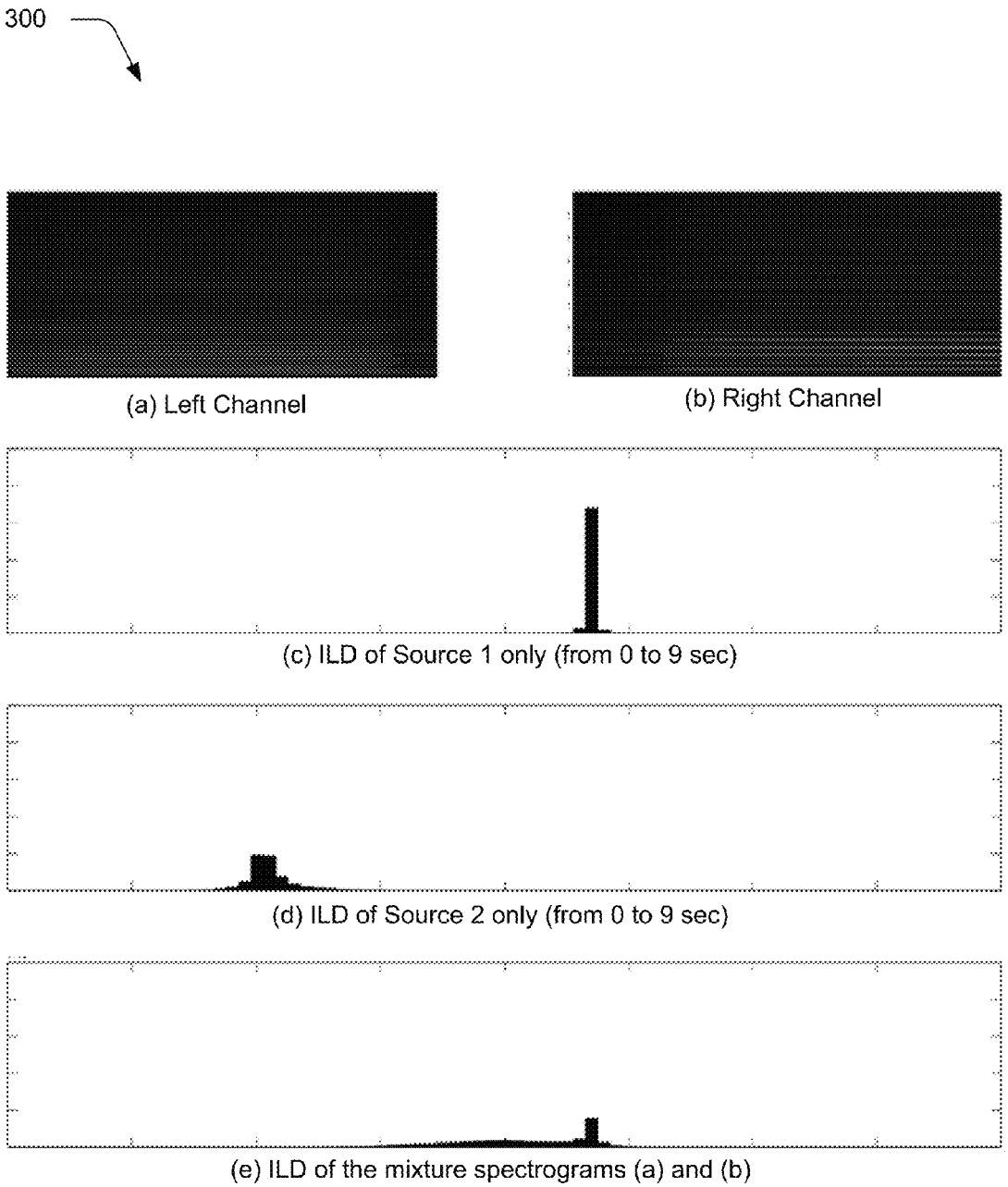

FIGS. 2 and 3 include examples 200, 300 of these cases. As shown in the example 200 in FIG. 2, the two sources (e.g., musical notes A4 and A5, respectively) do not overlap at all. Therefore, the original ILD histograms of the sources (c) and (d) are preserved even after mixing. The ILD distribution of the mixture signals clearly preserves the original two distinct peaks in (e). On the other hand, the example 300 of FIG. 3 illustrates a different case. Because the two notes overlap a significant, the original source ILDs are not preserved after mixing in (e), e.g., the peak around −20 disappeared. Thus, in this case the orthogonality does not hold and thus may cause conventional location techniques to fail as previously described.

Figure 4:
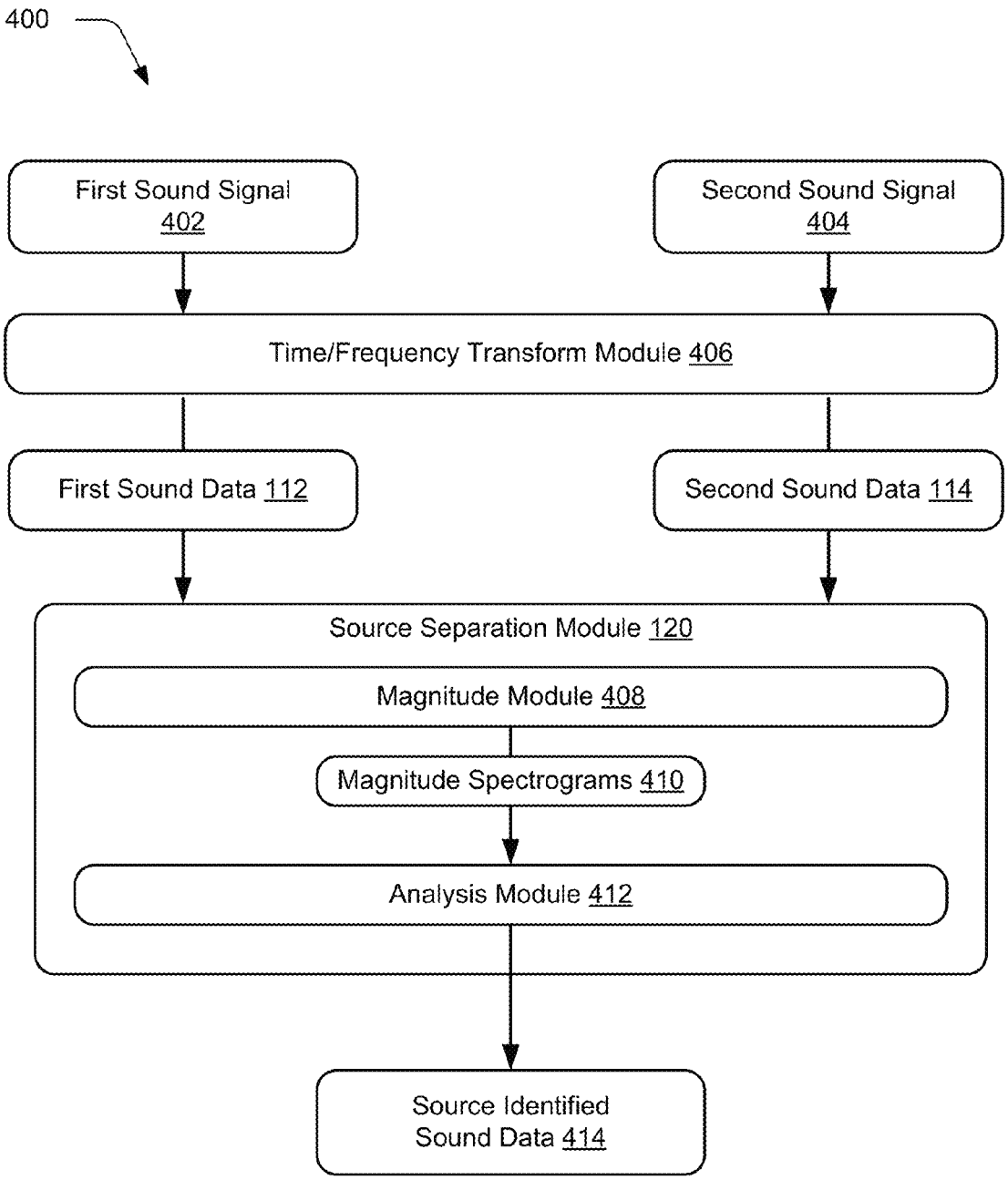
FIG. 4 depicts a system in an example implementation in which processed sound data is generated from the first and second sound data from FIG. 1.

However, through use of the sound separation module 120 in conjunction with the source position module 122 sound source identification and position 126 data may be generated even in instances in which portions of the sound data collide as further descried below. In the following discussion, a sound separation technique is first described. A discussion of use of sound data processed by the sound separation technique to determine a relative position then follows. Although examples of techniques are described, it should be readily apparent that a wide variety of other techniques may also be employed without departing from the spirit and scope thereof Sound Source Separation FIG. 4 depicts a system 400 in an example implementation in which processed sound data 126 is generated from the first and second sound data 112, 114 from FIG. 1. A first sound signal 402 and a second sound signal 404 are processed by a time/frequency transform module 406 to create the first sound data 112 and second sound data 114 of FIG. 1, which may be configured in a variety of ways.

The first and second sound data 112, 114, for instance, may be calculated as a time-frequency representation (e.g., spectrogram), such as through a short-time Fourier transform or other time-frequency transformation. This may be used to define input matrices "X(t,f,l)" where "t" and "f" are the index of time and frequency positions, respectively. The recordings index "l" is for the "l-th" recording from "L" total number of recordings in the following discussion.

The first and second sound data 112, 114, may then be received by a source separation module 120. The source separation module 120 may first employ a magnitude module 408 which is representative of functionality to take absolute values for the input matrices of the first and second sound data 112, 114 to generate magnitude spectrograms 410.

The magnitude spectrograms 410 may then be obtained by an analysis module 412 for processing to identify sound sources of the sound data. This may be performed using collaborative techniques such that "knowledge" shared in the processing of the first and second sound data 112, 114 may be shared, one with another. For example, the analysis module 412 may employ a branch of probabilistic latent component analysis (PLCA) in which desired sound data may be identified by sharing spectral and temporal aspects of the latent components that represent the source. In this way, collaboration in the analysis of the first and second sound data 112, 114 may be used to identify which portions of the sound data correspond to which sources.

The analysis module 412, for instance, may be configured to conduct PLCA on the input matrices of the magnitude spectrograms 410. However, during part of the PLCA learning process, parameters may be shared across the analyses of the first and second sound data 112, 114.

PLCA, for instance, may be used to decompose an input matrix into predefined number of components, each of which can be further factorized into a spectral basis vector, a temporal excitation, and a weight for the component. By multiplying those factors, a component of the input matrix may be recovered. As a component is expressed with probability of getting it given the observed time-frequency point, PLCA is used to infer the posterior probability of the component given the magnitude observed at each of the time/frequency positions.

Figure 5:
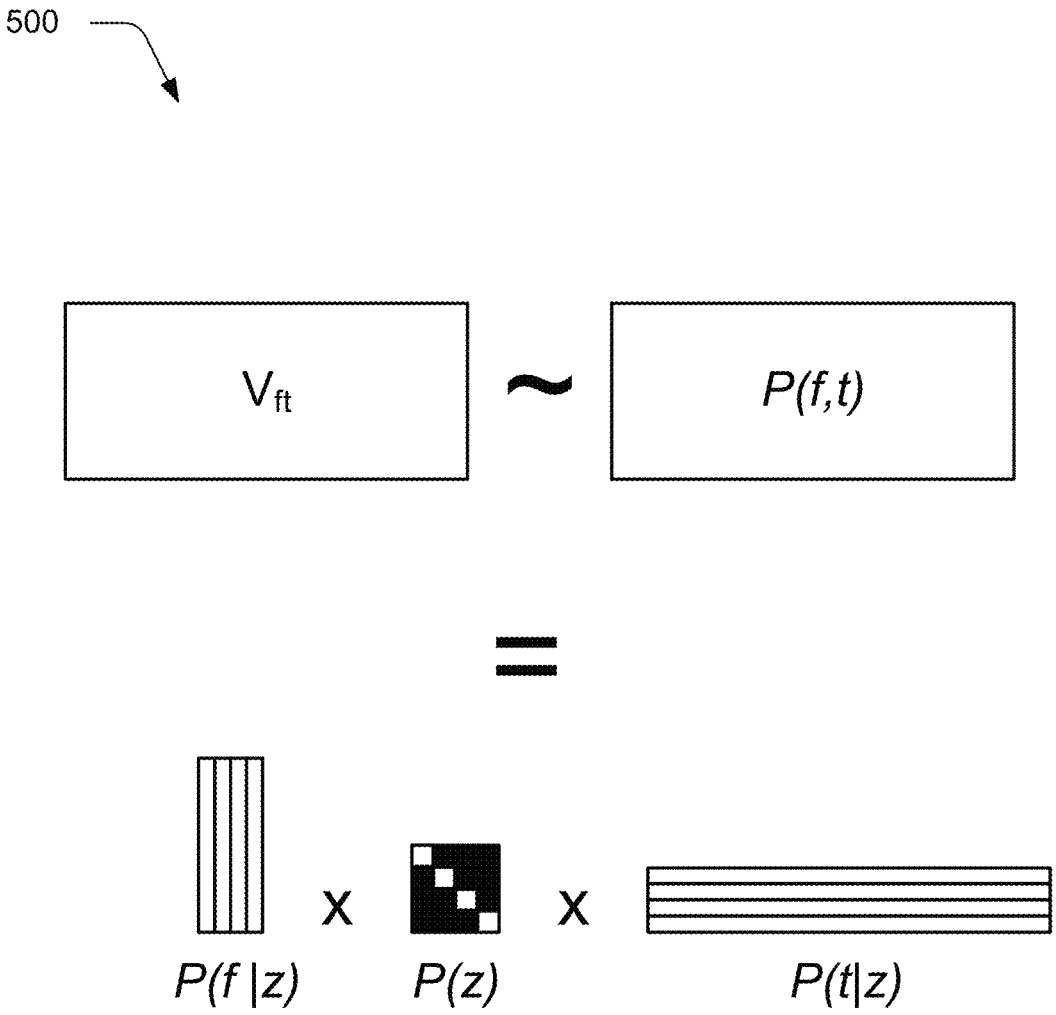
FIG. 5 depicts an example implementation in which a PLCS process is applied to three different inputs.

FIG. 5 depicts an example implementation 500 of a pictorial representation of PLCA as applied on an input matrix when there are four components. For example, "L" input matrixes may be obtained by the sound processing module 116 from sound data that correspond to magnitudes of short-time Fourier transformed sound signals as described in relation to FIG. 4.

Probabilistic latent component sharing (PLCS) is an evolution of PLCA that is configured to "tie up" common components across different channels into the same parameters. For instance, the first source (A4) in FIG. 2 in the left (a) and right (b) channels may be represented with the same parameters for its spectral shape P(f|z=1) and P(t|z=1). Therefore, the mixture spectrograms of the left and right channels can be decomposed into:

$$X^L(f,t) \sim P^L(f,t) = P((f|z=1)P(t|z=1)P^L(z=1) + P(f|z=2)P(t|z=2)P^L(z=2)$$

$$X^B(f,t) \sim P^R(f,t) = P(f|z=1)P(t|z=1)P^R(z=1) + P(f|z=2)P(t|z=2)P^R(z=2).$$

This model may be used to explain the panning behavior of sound sources. For instance, both left and right channels of the first sound source may be generated from the same template probability distribution "P(f, t|z)," but with different weight per channel and source "$P^L(z=1)$" and "$P^R(z=1)$." PLCS may therefore be utilized to learn these parameters from multichannel input spectrograms. The update rules may be expressed as follows:

$$E-\text{step} \quad P^c(z \mid f, t) = \frac{P(f \mid z)P(t \mid z)P^c(z)}{\Sigma_z P(f \mid z)P(t \mid z)P^c(z)}$$

$$P(f \mid z) = \frac{\Sigma_{c,t} X^c_{f,t} P^c(z \mid f, t)}{\Sigma_{c,f,t} X^c_{f,t} P^c(z \mid f, t)},$$

$$M-\text{step} \quad P(t \mid z) = \frac{\Sigma_{c,f} X^c_{f,t} P^c(z \mid f, t)}{\Sigma_{c,f,t} X^c_{f,t} P^c(z \mid f, t)},$$

$$P^c(z) = \frac{\Sigma_{f,t} X^c_{f,t} P^c(z \mid f, t)}{\Sigma_{z,f,t} X^c_{f,t} P^c(z \mid f, t)},$$

where "c" indicates channels.

The PLCS model may be harmonized with an ILD-based system or channel-based source separation and thus may be utilized in instances in which orthogonality of the sound sources does not hold.

PLCS-Based ILD Representation

Once the iterative EM updates converge to a local solution through the PLCS techniques described above as performed by the source separation module 120, posterior probabilities "Pc(z|f, t)" are obtained that can be used as soft masking values per channel, e.g., per the first sound data 112 and the second sound data 114. Therefore, ILD values may then be calculated by the source position module 122 per each component indicated by "z." In turn, the number of data points is boosted by the number of latent components:

$$ILD_z(f, t) = 20\log_{10} \frac{P^{c=L}(z \mid f, t)X^L(f, t)}{P^{c=R}(z \mid f, t)X^R(f, t)}$$

Because the mixture spectrogram is decomposed into z-th latent component, the possibility that the value contains a single source is increased as opposed to use of ILD alone.

Unsupervised Sound Source Separation

Figure 6:
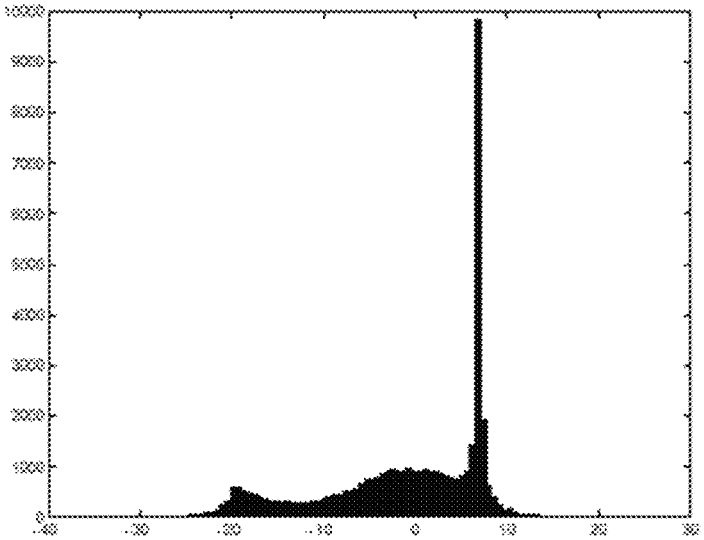
FIG. 6 shows a comparison of interchannel level difference (ILD) values calculated with and with use of a collaborative technique.
Figure 6:
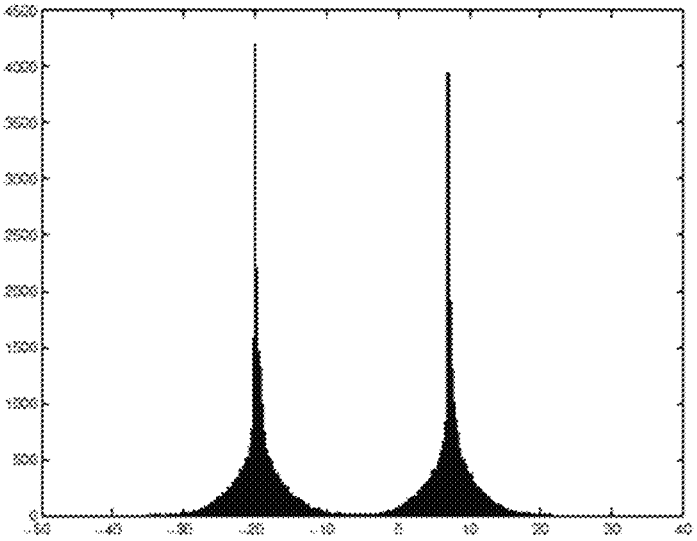

FIG. 6 shows an example 600 of a decomposed ILD representation can includes desired sharp peaks, each of which correspond to each panned source while the ordinary ILD representation fails to do that as shown in (a). The signals that are used to draw the histograms are similar ones used in FIG. 4 except the overlap of the sources is slightly mitigated.

Using these as an input, source separation may be performed by clustering those "$ILD_z$" values, using any of a variety of different clustering techniques. Then, masking values are obtained per each time, frequency, and component as follows:

$$\hat{S}_1^L(f,t) = \sum_z M_{s=1}(f,t,z)P^{c=L}(z \mid f,t)X^L(f,t)$$

$$\hat{S}_1^R(f,t) = \sum_z M_{s=1}(f,t,z)P^{c=R}(z \mid f,t)X^R(f,t)$$

$$\hat{S}_2^L(f,t) = \sum_z M_{s=2}(f,t,z)P^{c=L}(z \mid f,t)X^L(f,t)$$

$$\hat{S}_2^R(f,t) = \sum_z M_{s=2}(f,t,z)P^{c=R}(z \mid f,t)X^R(f,t)$$

Figure 7:
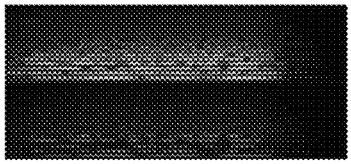
FIG. 7 shows a comparison of spectrograms computed using interchannel level difference (ILD) value techniques with and without use of a collaborative technique.
Figure 7:
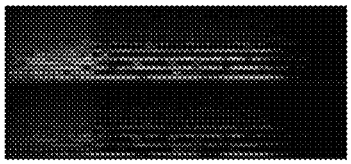
Figure 7:
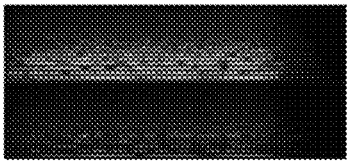
Figure 7:
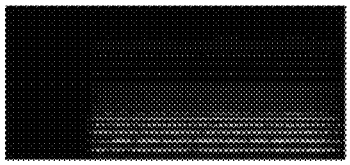
Figure 7:
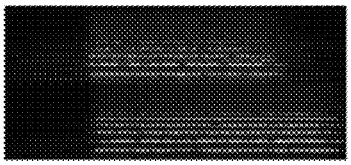
Figure 7:
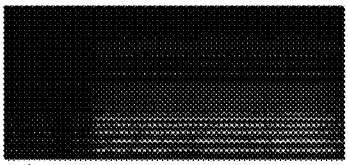

The separation results in the example 700 of FIG. 7 show that the proposed PLCS-based technique outperforms the conventional ILD technique.

Sound Source Separation with User Interaction

A posterior regularization technique may be utilized as a way to let a user influence the probabilistic matrix factorization. For example, posterior regularization may be utilized on sound data from different channels. For instance, assume that there are two sound sources, each of which can be decomposed into 5 latent variables. Then, the posterior regularization may change the posterior probabilities: E-step as follows:

$$P^c(z \mid f,t) = \frac{P(f \mid z)P(t \mid z)P^c(z)\Lambda_{f,t,z,c}}{\Sigma_z P(f \mid z)P(t \mid z)P^c(z)\Lambda_{f,t,z,c}}$$

For example, a user may mark that the left peak in the example 600 in FIG. 6, part (b) as a first sound source and the right one as correspond to a second sound source. Then, high values may then be set for "$\Lambda_{f,t,z,c}$" whose indices "f,t,z" are the same with the ones selected for the first sound source.

Example Procedures

The following discussion describes sound data identification and position techniques that may be implemented utilizing the previously described systems and devices. Aspects of each of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference will be made to FIGS. 1-7.

Figure 8:
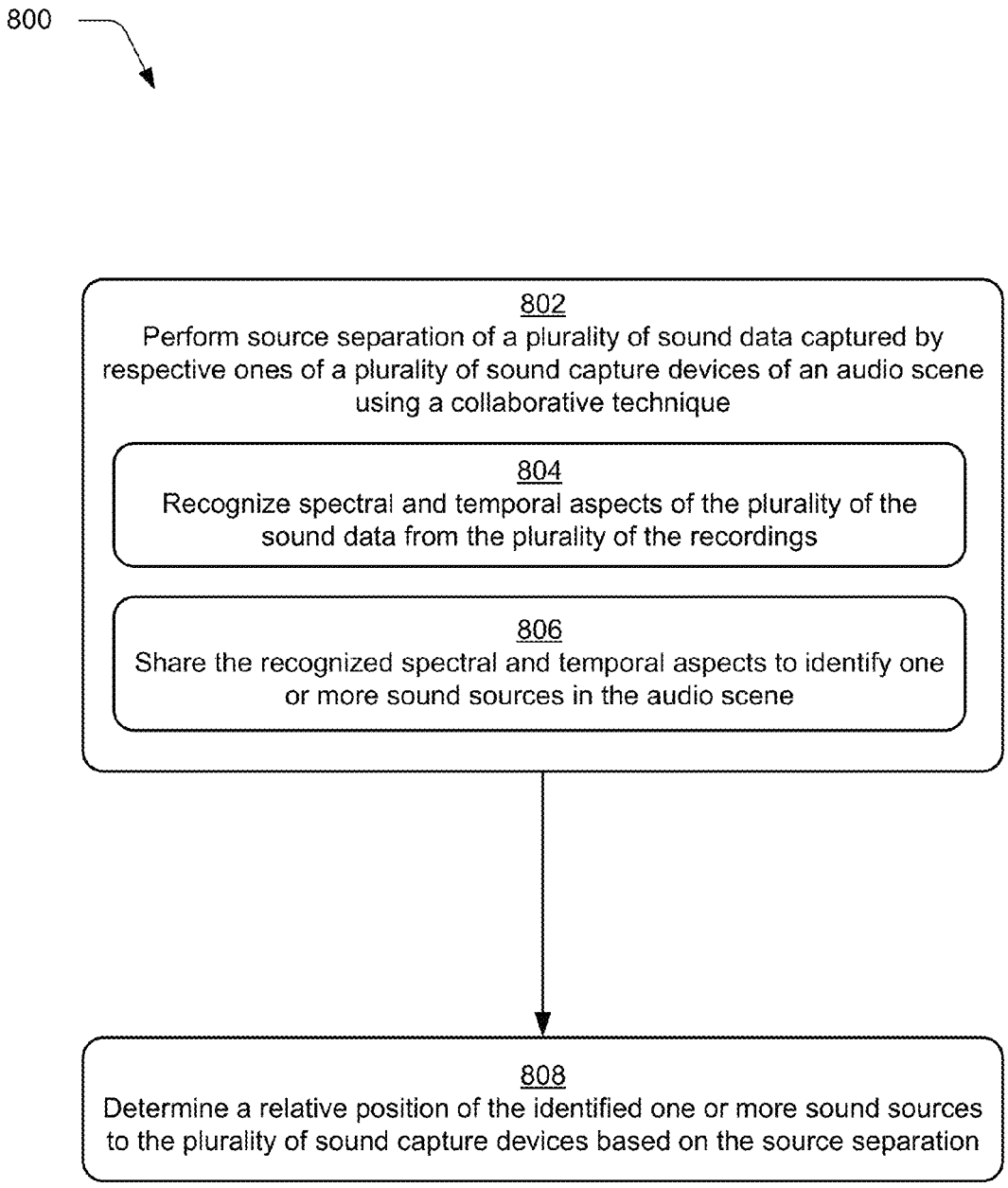
FIG. 8 is a flow diagram depicting a procedure in an example implementation in which source separation and identification techniques are shown.

FIG. 8 depicts a procedure 800 in an example implementation in which source identification and location techniques are described. Source separation is performed using a collaborative technique for a plurality of sound data of an audio scene that was captured by respective ones of a plurality of sound capture devices (block 802). For example, sound capture devices 104, 106 may be utilized to capture multichannel sound. The device may be implemented as stand-alone devices, as a single device (e.g., having a plurality of microphones), and so on.

The source separation is performed by recognizing spectral and temporal aspects from the plurality of sound data (block 804) and sharing the recognized spectral and temporal aspects, one with another, to identify one or more sound sources in the audio scene (block 806). As described above, posterior probabilities that may be used as soft masking values per channel may be obtained once the EM updates converge to a local solution as a result of the PLCS technique performed by the source separation module 120.

A relative position of the identified one or more sound sources to the plurality of sound capture devices is determined based on the source separation (block 808). Continuing with the example above, ILD values may be calculated through clustering as previously described by the source position module 122. In this way, a relative position of each of the sound sources may be obtained, e.g., as a panning position. Other geometric positioning is also contemplated, e.g., through use of more than two channels.

Example System and Device

Figure 9:
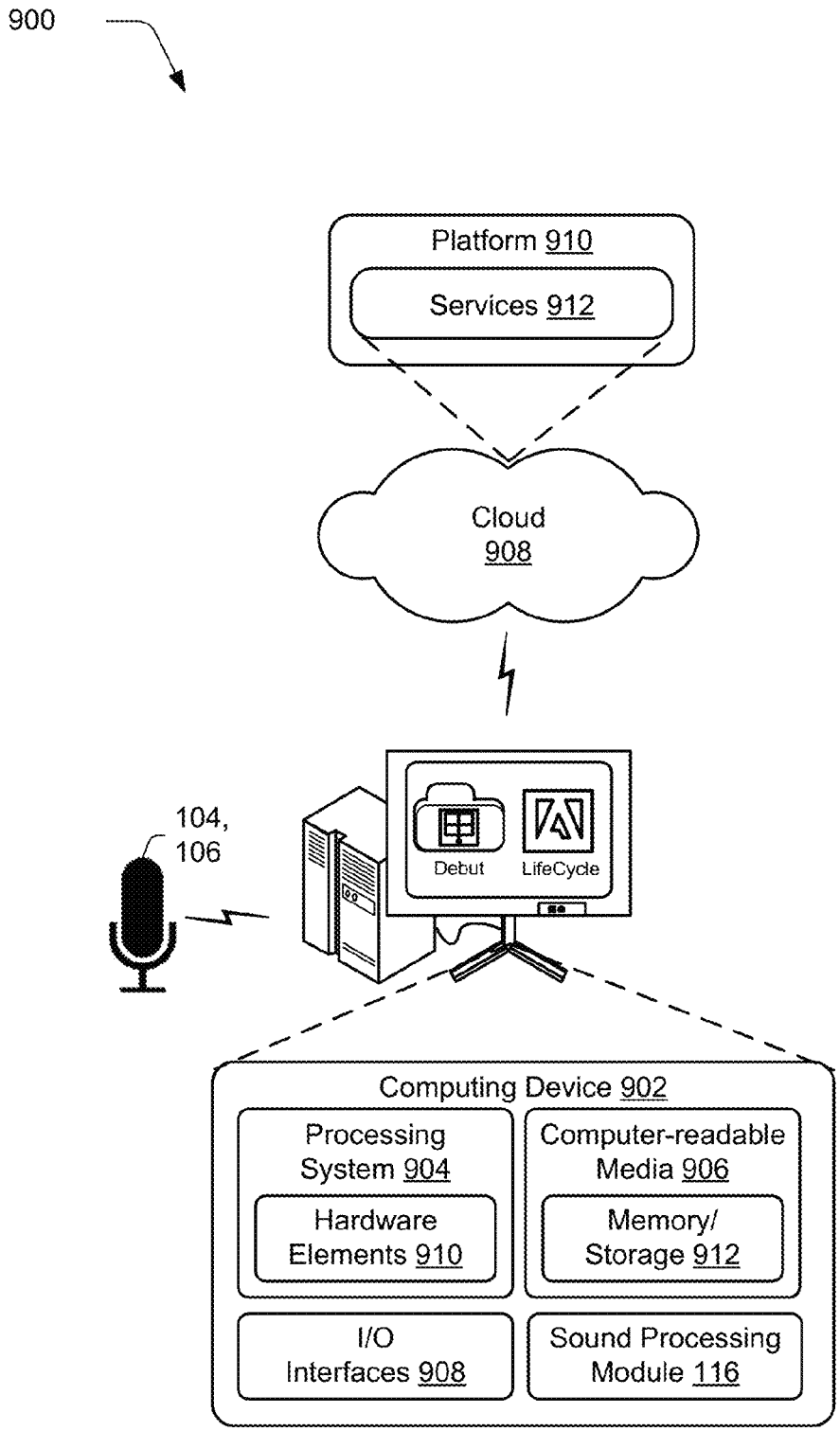
FIG. 9 illustrates an example system including various components of an example device that can be implemented as any type of computing device as described with reference to FIGS. 1-8 to implement embodiments of the techniques described herein.

FIG. 9 illustrates an example system generally at 900 that includes an example computing device 902 that is representative of one or more computing systems and/or devices that may implement the various techniques described herein. This is illustrated through inclusion of the sound processing module 116, which may be configured to process sound data, such as sound data captured by an sound capture devices 104,106 configured to capture multichannel sound data. The computing device 902 may be, for example, a server of a service provider, a device associated with a client (e.g., a client device), an on-chip system, and/or any other suitable computing device or computing system.

The example computing device 902 as illustrated includes a processing system 904, one or more computer-readable media 906, and one or more I/O interface 908 that are communicatively coupled, one to another. Although not shown, the computing device 902 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 904 is representative of functionality to perform one or more operations using hardware. Accordingly, the processing system 904 is illustrated as including hardware element 910 that may be configured as processors, functional blocks, and so forth. This may include implementation in hardware as an application specific integrated circuit or other logic device formed using one or more semiconductors. The hardware elements 910 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions.

The computer-readable storage media 906 is illustrated as including memory/storage 912. The memory/storage 912 represents memory/storage capacity associated with one or more computer-readable media. The memory/storage component 912 may include volatile media (such as random access memory (RAM)) and/or nonvolatile media (such as read only memory (ROM), Flash memory, optical disks, magnetic disks, and so forth). The memory/storage component 912 may include fixed media (e.g., RAM, ROM, a fixed hard drive, and so on) as well as removable media (e.g., Flash memory, a removable hard drive, an optical disc, and so forth). The computer-readable media 906 may be configured in a variety of other ways as further described below.

Input/output interface(s) 908 are representative of functionality to allow a user to enter commands and information to computing device 902, and also allow information to be presented to the user and/or other components or devices using various input/output devices. Examples of input devices include a keyboard, a cursor control device (e.g., a mouse), a microphone, a scanner, touch functionality (e.g., capacitive or other sensors that are configured to detect physical touch), a camera (e.g., which may employ visible or non-visible wavelengths such as infrared frequencies to recognize movement as gestures that do not involve touch), and so forth. Examples of output devices include a display device (e.g., a monitor or projector), speakers, a printer, a network card, tactile-response device, and so forth. Thus, the computing device 902 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 902. By way of example, and not limitation, computer-readable media may include "computer-readable storage media" and "computer-readable signal media."

"Computer-readable storage media" may refer to media and/or devices that enable persistent and/or non-transitory storage of information in contrast to mere signal transmission, carrier waves, or signals per se. Thus, computer-readable storage media refers to non-signal bearing media. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" may refer to a signal-bearing medium that is configured to transmit instructions to the hardware of the computing device 902, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 910 and computer-readable media 906 are representative of modules, programmable device logic and/or fixed device logic implemented in a hardware form that may be employed in some embodiments to implement at least some aspects of the techniques described herein, such as to perform one or more instructions. Hardware may include components of an integrated circuit or on-chip system, an application-specific integrated circuit (ASIC), a field-programmable gate array (FPGA), a complex programmable logic device (CPLD), and other implementations in silicon or other hardware. In this context, hardware may operate as a processing device that performs program tasks defined by instructions and/or logic embodied by the hardware as well as a hardware utilized to store instructions for execution, e.g., the computer-readable storage media described previously.

Combinations of the foregoing may also be employed to implement various techniques described herein. Accordingly, software, hardware, or executable modules may be implemented as one or more instructions and/or logic embodied on some form of computer-readable storage media and/or by one or more hardware elements 910. The computing device 902 may be configured to implement particular instructions and/or functions corresponding to the software and/or hardware modules. Accordingly, implementation of a module that is executable by the computing device 902 as software may be achieved at least partially in hardware, e.g., through use of computer-readable storage media and/or hardware elements 910 of the processing system 904. The instructions and/or functions may be executable/operable by one or more articles of manufacture (for example, one or more computing devices 902 and/or processing systems 904) to implement techniques, modules, and examples described herein.

The techniques described herein may be supported by various configurations of the computing device 902 and are not limited to the specific examples of the techniques described herein. This functionality may also be implemented all or in part through use of a distributed system, such as over a "cloud" 920 via a platform 922 as described below.

The cloud 920 includes and/or is representative of a platform 922 for resources 924. The platform 922 abstracts underlying functionality of hardware (e.g., servers) and software resources of the cloud 920. The resources 924 may include applications and/or data that can be utilized while computer processing is executed on servers that are remote from the computing device 902. Resources 924 can also include services provided over the Internet and/or through a subscriber network, such as a cellular or Wi-Fi network.

The platform 922 may abstract resources and functions to connect the computing device 902 with other computing devices. The platform 922 may also serve to abstract scaling of resources to provide a corresponding level of scale to encountered demand for the resources 924 that are implemented via the platform 922. Accordingly, in an interconnected device embodiment, implementation of functionality described herein may be distributed throughout the system 900. For example, the functionality may be implemented in part on the computing device 902 as well as via the platform 922 that abstracts the functionality of the cloud 920.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A method implemented by one or more computing devices, the method comprising:

performing source separation of a plurality of sound data captured by respective ones of a plurality of sound capture devices of an audio scene using a collaborative technique that includes:

recognizing spectral and temporal aspects from the plurality of sound data; and sharing the recognized spectral and temporal aspects, one with another, to identify one or more sound sources in the audio scene; and determining a relative position of the identified one or more sound sources to the plurality of sound capture devices based on the source separation.

2. A method as described in claim 1, wherein the recognizing and the sharing are performed at least in part using probabilistic latent component analysis (PLCA).

3. A method as described in claim 2, wherein the probabilistic latent component analysis is configured to perform the recognizing by decomposing the sound data into a predefined number of components, each of which is further factorized into a spectral basis vector, a temporal excitation, and a weight for the component to recognize the spectral and temporal aspects of the plurality of the sound data, respectively.

4. A method as described in claim 3, wherein the sound data is in a form of input matrices having an index of time and frequency positions for respective ones.

5. A method as described in claim 1, wherein the determining of the relative position is performed by calculating an interchannel level difference (ILD).

6. A method as described in claim 1, wherein the relative position is a panning position.

7. A method as described in claim 1, wherein the plurality of sound data is in a form of time/frequency representations.

8. A method as described in claim 7, wherein the time-frequency representations are calculated as short-time Fourier transforms.

9. A method as described in claim 1, wherein the plurality of sound data is captured from the audio scene, simultaneously.

10. A method as described in claim 1, wherein the performing of the sound separation is at least semi-supervised through use of one or more user inputs.

11. A system comprising:

one or more modules implemented at least partially in hardware and configured to perform operations including performing source separation of a plurality of sound data of an audio scene using a collaborative technique that includes sharing recognized spectral and temporal aspects, one to another, to identify one or more sound sources in the audio scene; and at least one module implemented at least partially in hardware and configured to perform operations including determining a relative position of the identified one or more sounds sources based on the source separation.

12. A system as described in claim 11, wherein the sound separation is performed at least in part using probabilistic latent component analysis (PLCA).

13. A system as described in claim 11, wherein the determination of the relative position is performed by calculating an interchannel level difference (ILD).

14. A system as described in claim 11, wherein the relative position is calculated with respective to sound capture devices that were utilized to capture respective ones of the plurality of sound data.

15. One or more non-transitory computer-readable storage media comprising instructions stored thereon that, responsive to installation on and execution by a computing device, causes the computing device to perform operations comprising:

performing source separation of a plurality of sound data, captured by respective ones of a plurality of sound capture devices of an audio scene, using a collaborative technique that includes:

recognizing spectral and temporal aspects from the plurality of sound data; and sharing the recognized spectral and temporal aspects, one with another, to identify one or more sound sources in the audio scene; and determining a relative position of the identified one or more sounds sources to the plurality of sound capture devices based on the source separation.

16. One or more non-transitory computer-readable storage media as described in claim 15, wherein the recognizing and the sharing are performed at least in part using probabilistic latent component analysis (PLCA).

17. One or more non-transitory computer-readable storage media as described in claim 16, wherein the probabilistic latent component analysis is configured to perform the recognizing by decomposing the sound data into a predefined number of components, each of which is further factorized into a spectral basis vector, a temporal excitation, and a weight for the component to recognize the spectral and temporal aspects of the plurality of the sound data, respectively.

18. One or more non-transitory computer-readable storage media as described in claim 15, wherein the determining of the relative position is performed by calculating an interchannel level difference (ILD).

19. One or more non-transitory computer-readable storage media as described in claim 15, wherein the relative position is a panning position.

20. One or more non-transitory computer-readable storage media as described in claim 15, wherein the performing of the sound separation is at least semi-supervised through use of one or more user inputs.

* * * * *